US005299655A

United States Patent [19]

Margaritis

[11] Patent Number: 5,299,655

[45] Date of Patent: Apr. 5, 1994

[54] WORKPLACE SUPPORT AND ENCLOSURE

[76] Inventor: Nicholas Margaritis, RD. #3, 3278 Main St., Kirkwood, N.Y. 13795

[21] Appl. No.: 63,764

[22] Filed: May 20, 1993

[51] Int. Cl.[5] ..... E04G 21/30

[52] U.S. Cl. ..... 182/138; 182/129; 182/150

[58] Field of Search ..... 182/137, 140, 129, 150

[56] References Cited

U.S. PATENT DOCUMENTS 4,854,419 8/1989 Lyras et al. ..... 182/129

5,011,710 4/1991 Harrison ..... 182/150 X

FOREIGN PATENT DOCUMENTS 1482175 5/1967 France ..... 182/138

*Primary Examiner*—Alvin C. Chin-shue

*Attorney, Agent, or Firm*—Charles S. McGuire

[57] ABSTRACT

An enclosed workplace support for temporary, immovable installation below and on each side of a bridge or other existing structure while performing work on bridge substructure. Double rows of upper and lower outriggers are installed to extend outwardly from each lateral side of the bridge and cables are attached to the outer ends of each row of outriggers. Additional cables are attached at opposite ends to bearings or other bridge substructure and extend parallel to the bridge centerline for an entire span. The cables support a high-strength flooring, preferably or rubber-coated chain link fencing. A nylon tarp is laid over the fencing below the bridge and extends around each side, attached to the outrigger cables, and is sealed to the bridge curbs. An exhaust blower maintains the interior of the enclosed workplace at subatmospheric pressure.

20 Claims, 6 Drawing Sheets

WORKPLACE SUPPORT AND ENCLOSURE

BACKGROUND OF THE INVENTION

The present invention relates to suspended, enclosed structures providing a workplace beneath bridges, and the like. More specifically, the invention relates to a combination of elements which are temporarily mounted upon bridges or other structures while work is performed on substructure thereof to provide a thoroughly safe support for workmen, as well as a cost-effective, environmentally acceptable workplace.

In performing tasks such as sandblasting, painting, structural repairs, etc. upon substructure of existing bridges and other structures, it is necessary to provide a platform of some type to support the persons performing the task. Traditionally, such platforms have been provided by temporarily erected scaffolding or other such structure supported on the ground, etc. beneath the bridge, or suspended in some fashion from the bridge. Provisions must be made, of course, to enhance the safety of such workplace supports, which may require workmen to wear safety belts or tethers and the provision of suitable guard railings, as well as ensuring adequate load-bearing capabilities and structural stability of the supports.

More recently, environmental protection standards have been imposed on the performance of some types of work associated with renovation and repair of bridges, viaducts, elevated highways, etc. These standards may require, for example, that potentially harmful or toxic substances generated during performance of the work be prevented from entering the atmosphere, leaching into the soil, or being deposited in surface or ground water or upon other objects. Meeting such standards often involves constructing a complete enclosure about the workplace, and maintaining the interior of such enclosure at a subatmospheric pressure.

Recent examples of enclosed workplace supports for use in such applications include those disclosed in U.S. Pat. No. 4,854,419, issued Aug. 8, 1989 to Lyras et al, and U.S. Pat. No. 5,011,710, issued Apr. 30, 1991 to Harrison. The structures of both of these patents are in the nature of enclosed modules suspended by trolley systems for movement laterally and/or longitudinally of the bridge substructure as work progresses. Government regulations and/or laws require that workmen wear suitable safety belts while positioned on mobile workplace supports. This adds to the time and cost of the job, as well as hampering freedom of movement. Also, construction of these mobile supports requires fabrication of many specialized components and/or substantial modification of existing elements. Furthermore, the supports can be mounted only upon certain types of existing bridge structures. Substantial time and costs are involved in erecting and removing these workplace supports.

It is an object of the present invention to provide a support for workmen performing tasks on substructure of an existing bridge, or the like, which effectively eliminates the possibility of a workman falling while positioned on the support.

It is another object to provide an improved, fully enclosed workplace support which complies with all current environmental protection standards regarding emission and containment of toxic or otherwise prohibited substances.

A further object is to provide an enclosed workplace support for temporary installation in fixed relation to existing structures such as bridges which is relatively fast and economical to install and remove.

Still another object is to provide an enclosed, suspended workplace support for performing tasks on substructures of bridges, and the like, which has a high load-bearing capacity, yet adds little wind load to the structure to which it is attached.

A still further object is to provide a support system for workmen which is comprised of a combination of elements most of which are readily commercially available, without substantial modification.

An additional object is to provide an enclosed workplace having a relatively small volume compared to the available work area.

In a more general sense, the object of the invention is to provide a novel and improved, fully enclosed, suspended workplace for installation upon and removal from bridges and other such structures.

SUMMARY OF THE INVENTION

In accordance with the foregoing objects, the invention contemplates a sling-like structure extending from each side of a bridge laterally across and spaced downwardly from the lower side thereof. Outriggers are attached to the railings and I-beams, or other existing structure, in upper and lower, horizontal rows extending outwardly from both sides of the bridge. Wire rope cables are attached to the outer ends of each of the upper and lower sets of outriggers and tensioned to extend longitudinally of the bridge, outwardly of each side thereof. A further plurality of wire rope cables are attached at opposite ends to bearings, cross beams or other existing bridge structure, extending parallel to one another, and to the longitudinal centerline of the bridge below the I-beams or other underlying bridge supports. The cables beneath the I-beams are supported at intermediate positions by chains attached at suitably spaced points to the lower flanges of the I-beams.

A high-strength mesh material such as 9 gage galvanized chain link fencing, preferably plastic or rubber coated, is placed beneath the I-beams on top of and supported by all except the two outermost cables. The fencing is passed under the outermost cables, over the lower outrigger cables and terminates at side edges adjacent the upper outrigger cables outwardly of each side of the bridge. Each of the cables is affixed to the fencing at desired intervals by appropriate clips. Sufficient fencing is provided to cover all cables for the entire bridge span to be operated upon.

After the fencing is in place, it is covered by a layer of flexible, essentially non-porous material such as nylon tarpaulin. The tarp completely covers the upper and inner sides of the fencing beneath and on each side of the bridge and is attached to the fencing and/or cables by clips extending through eyelets or other openings in the tarp. From the terminal side edges of the fencing the tarp is extended over the bridge railings and downwardly to the curbs along each upper side of the bridge and secured under boards which are nailed to the curbs. The tarp is likewise secured at each end to piers, cross beams or other bridge substructure, providing a completely enclosed work area beneath the bridge.

One or more openings are provided in the fencing and tarp for entrance and exit to and from the enclosed space. Preferably, a rolling scaffold, enclosed on the sides and bottom by nylon tarp and having a ladder, is placed below the entrance/exit opening to provide an air lock entry. The enclosed space communicates through one or more additional openings and suitable tubing with an exhaust system including one or more blowers and a conventional baghouse or other collection means to prevent discharge into the atmosphere of airborne particles withdrawn from the enclosed space. A subatmospheric pressure is thus maintained within the enclosed workplace to meet environmental requirements. Additional openings or vents may be provided as required for proper ventilation of the enclosed workplace.

The foregoing and other features of the invention will be more readily understood and fully appreciated from the following detailed disclosure, taken in conjunction wit the accompanying drawings, wherein:

DETAILED DESCRIPTION

Figure 1:
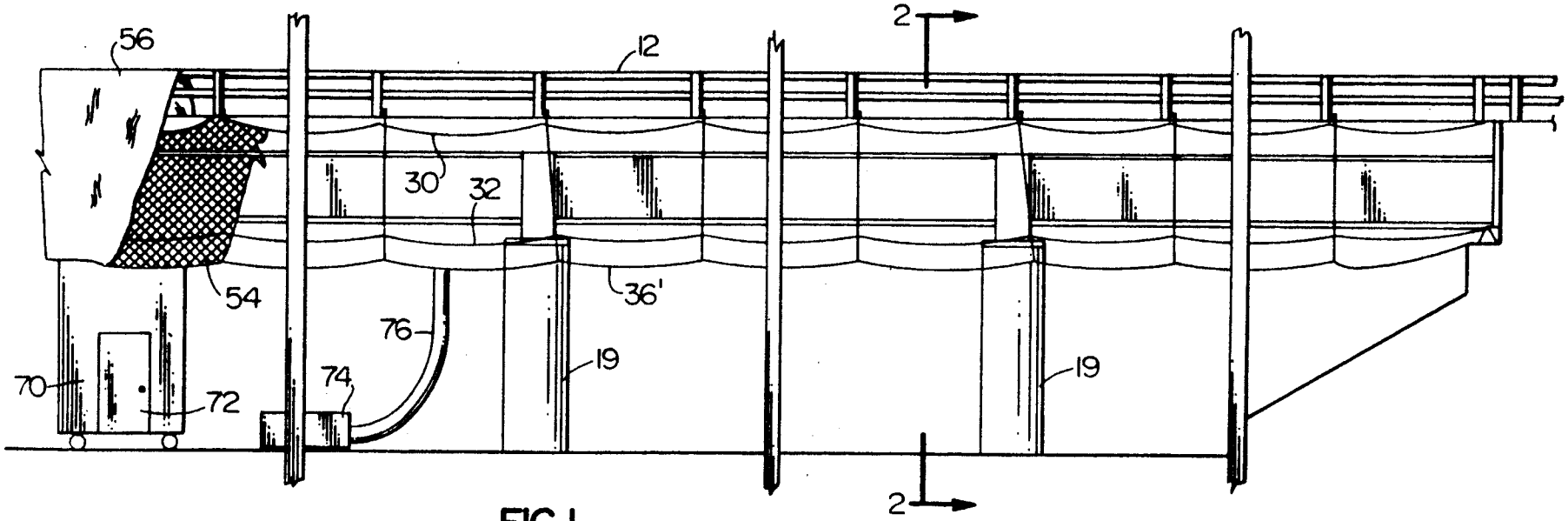
FIG. 1 is a side elevational view of a portion of a bridge with the workplace support and enclosure of the present invention, with portions broken away, installed thereon.

Referring now to the drawings, the workplace support and enclosure of the invention is shown in a preferred embodiment in conjunction with a conventional bridge structure, such as a highway overpass. Although the illustrated bridge structure is typical of the sort of existing structure with which the invention is employed, it will be understood that many variations in both type of structure and details thereof are possible without departing from the principles of the invention.

Elements of the bridge structure illustrated herein include deck or roadway 10, railings 12 and curbs 14 extending along each side of deck 10, a plurality of parallel I-beams 16 extending longitudinally of the bridge and forming portions of its substructure, bearings 18 supporting I-beams 16 at their opposite ends, piers 19 and cross beams 20 which may be located at the bridge abutments or at intermediate positions along its length. For purposes of discussion, one complete span of the bridge will be considered any portion between two successive piers and/or lateral supports. Furthermore, although the substructure may include other cross members, tie rods, etc. which assist in bridge support and may be considered to extend laterally thereof, the term lateral support is used herein to denote structure which separates successive spans, or which terminates the spans at each end of the bridge.

In erecting the enclosed workplace support of the present invention, a succession of upper outriggers 22 is attached to railing 12 or other existing bridge structure to extend outwardly from each lateral side thereof. Upper outriggers 22 are spaced from one another at suitable intervals in horizontal rows and extend outwardly to terminal ends 24. Lower outriggers 26 are attached to portions of the bridge substructure, such as the lower flanges of the outer I-beams or facia beams, to extend outwardly to terminal ends 28 in horizontal rows along each side of the bridge. Preferably, one of lower outriggers 26 is installed directly below each of upper outriggers 22. Wire rope cables 30 are installed along terminal ends 24 of the two rows of upper outriggers 22, extending through openings or notches in the ends of the outriggers, or otherwise suitably attached thereto. Likewise, cables 32 are installed upon and extend along terminal ends 28 of upper outriggers 26. Outrigger support cables 34 are affixed to upper portions of railings 12, or other bridge structure above the inner ends of upper outriggers 22, and are attached to terminal ends 24 and 28 of upper and lower outriggers 22 and 26, respectively.

Figure 6:
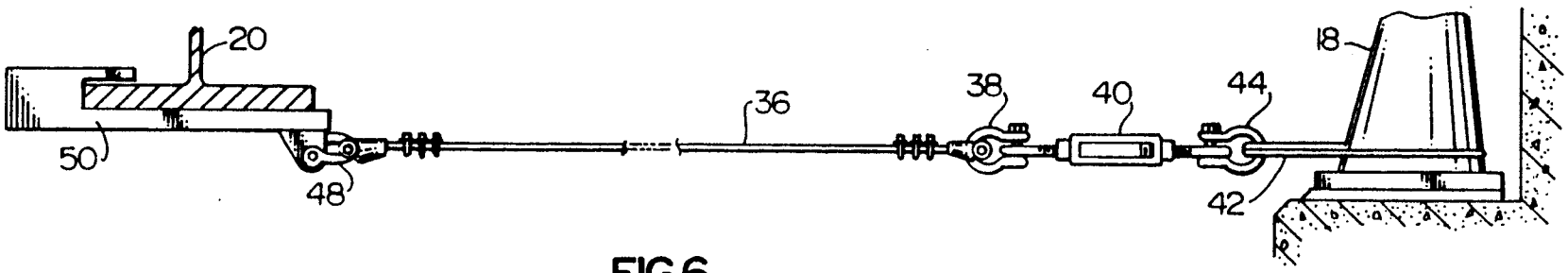
FIG. 6 is a fragmentary side elevational view showing an example of how the cables may be secured to portions of the bridge substructure.
Figure 2:
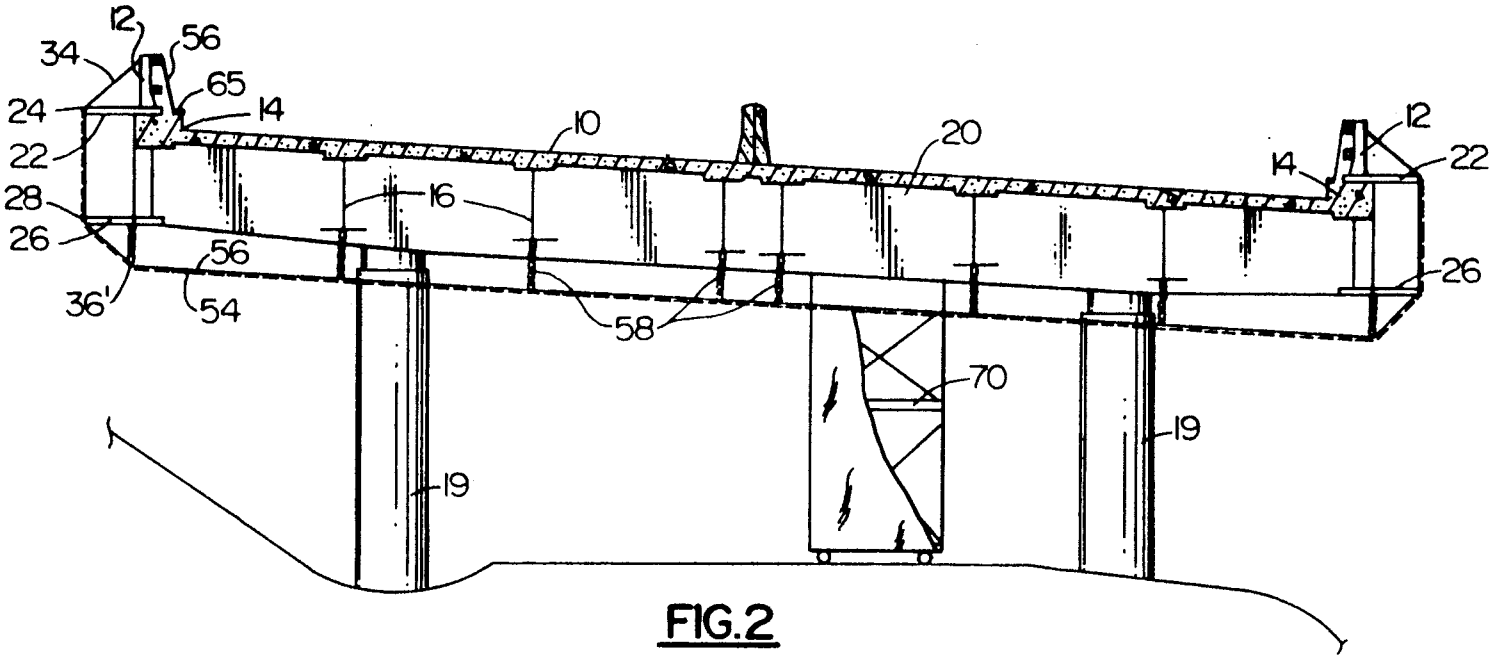
FIG. 2 is an end elevational view in section on the line 2—2 of FIG. 1.
Figure 4:
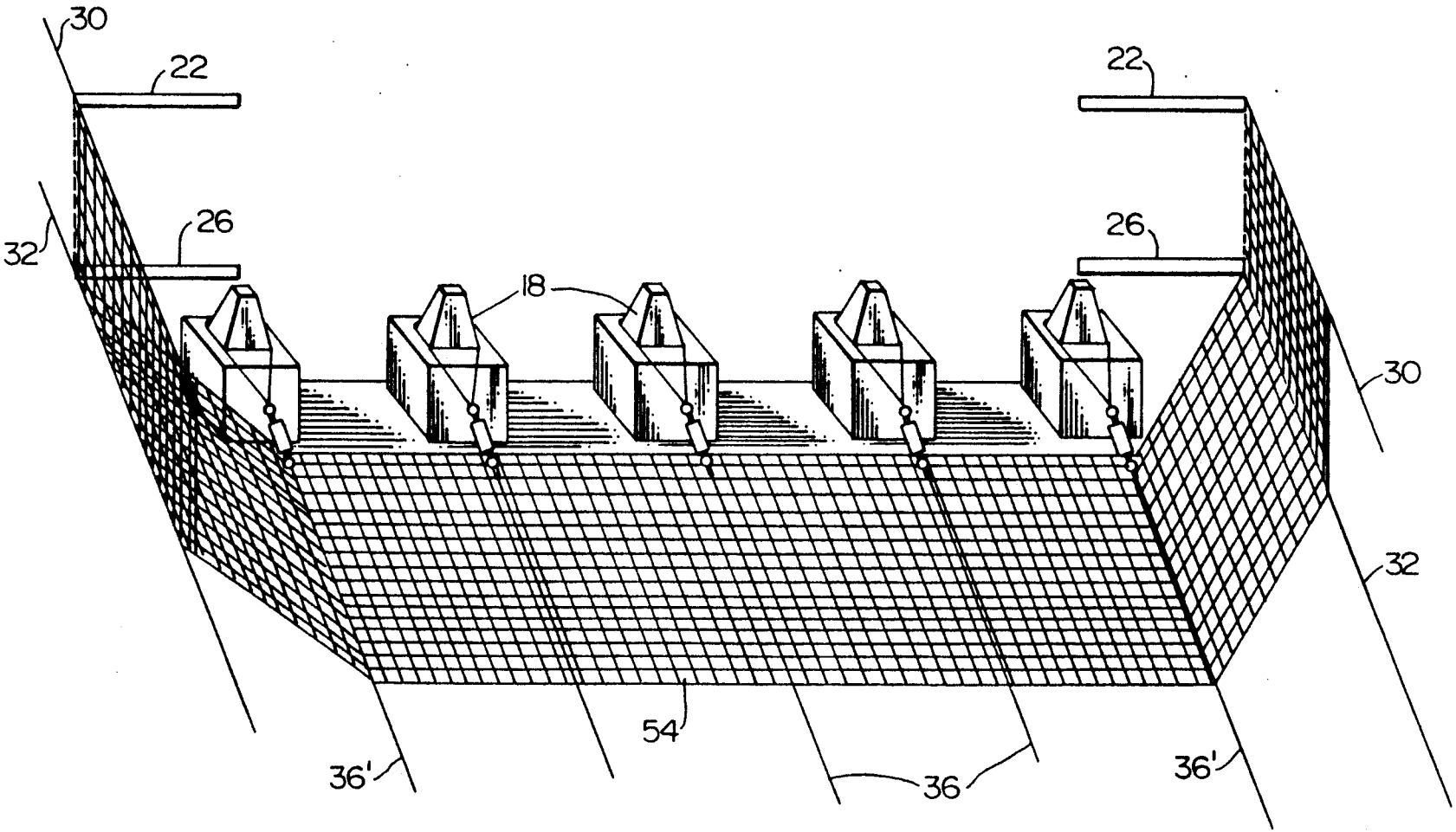
FIG. 4 is a perspective view showing portions of the bridge substructure with portions of the invention attached thereto.

A plurality of cables 36 is installed below the bridge substructure by attaching opposite ends of each cable to essentially immovable portions of the substructure at or substantially adjacent the underlying supports at each end of a span. For example, as shown in FIGS. 4 and 6, each of cables 36 may be looped around a respective clevis 38 at one end of turnbuckle 40, and cable sling 42 passed through clevis 44 at the opposite end of the turnbuckle and around beam support bearing 18 at one end of the span. The opposite ends of cables 36 may likewise be secured to bearings at the opposite end of the span, or one or both ends may be secured to a respective clevis 48 attached to beam hook 50 engaged with a lower flange of laterally extending beam 20 of the existing bridge substructure, as shown in FIG. 6.

After cables 36 are installed, preferably extending parallel to one another and to the bridge longitudinal centerline, slack is removed to a desired degree with a comealong jack and the cable ends secured by suitable clamps in known manner. When all cables are in place, a load-bearing support floor and side structure, preferably of plastic or rubber coated, galvanized, chain link fence 54 is installed. This may be accomplished by unrolling a suitable length of such fencing to lie upon all of cables 36 except the two outermost of such cables, indicated by reference numerals 36'. Fencing 54 is extended under each of cables 36', around cables 32 and attached by any suitable clip or fastener to cables 30 along each of the lateral sides of fencing 54.

When installation of fencing 54 is complete, a layer of flexible fabric 56, such as nylon tarpaulin or other substantially fluid-impermeable material, is installed. Tarp 56 overlies the portion of fencing 54 beneath the bridge substructure, and extends upwardly, inside the side portions of the fencing, being affixed to cables 30 and 32, and/or the side portions of the fencing, by rings or clips extending through small openings in the tarp. If desired, similar clips may be employed to secure tarp 56 to cables 36, 36' and/or the more or less horizontal portion of fencing 54 beneath the bridge substructure. Chains 58 are attached at one end to I-beams 16 or other portions of the bridge substructure, and to cables 36, 36' as required for intermediate support of the cables. Although subject to considerable variation to suit the type of bridge structure and nature of the work being performed, a typical vertical clearance between the bottom of I-beams 16 and the "floor" of the enclosure would be on the order of 3 feet. As with the clips, chains 58 pass through openings in tarp 56 which are as small as possible for the size of chain used.

Figure 5:
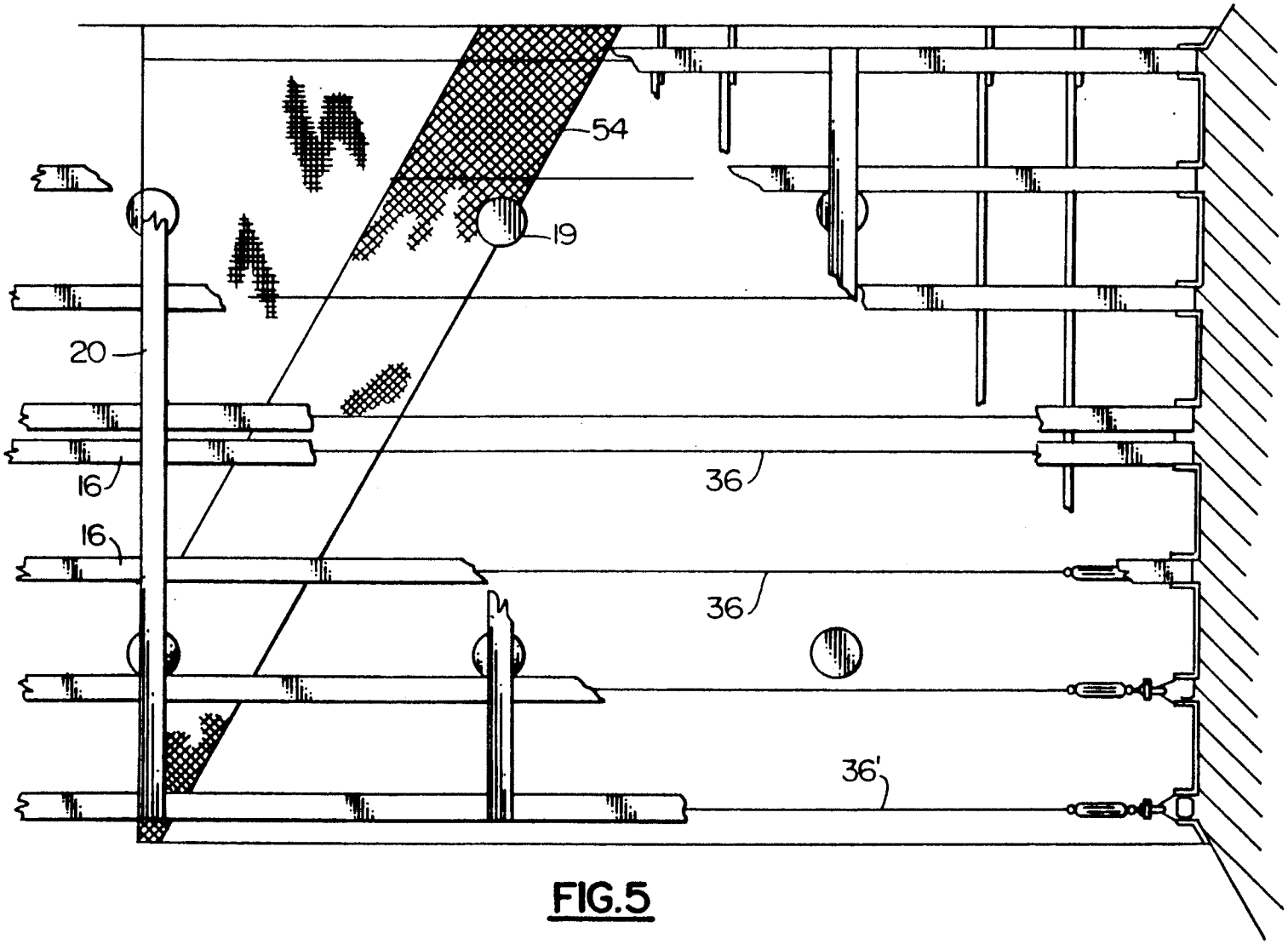
FIG. 5 is a perspective view from above a portion of a bridge structure with the workplace support of the invention mounted thereon and portions broken away.
Figure 9:
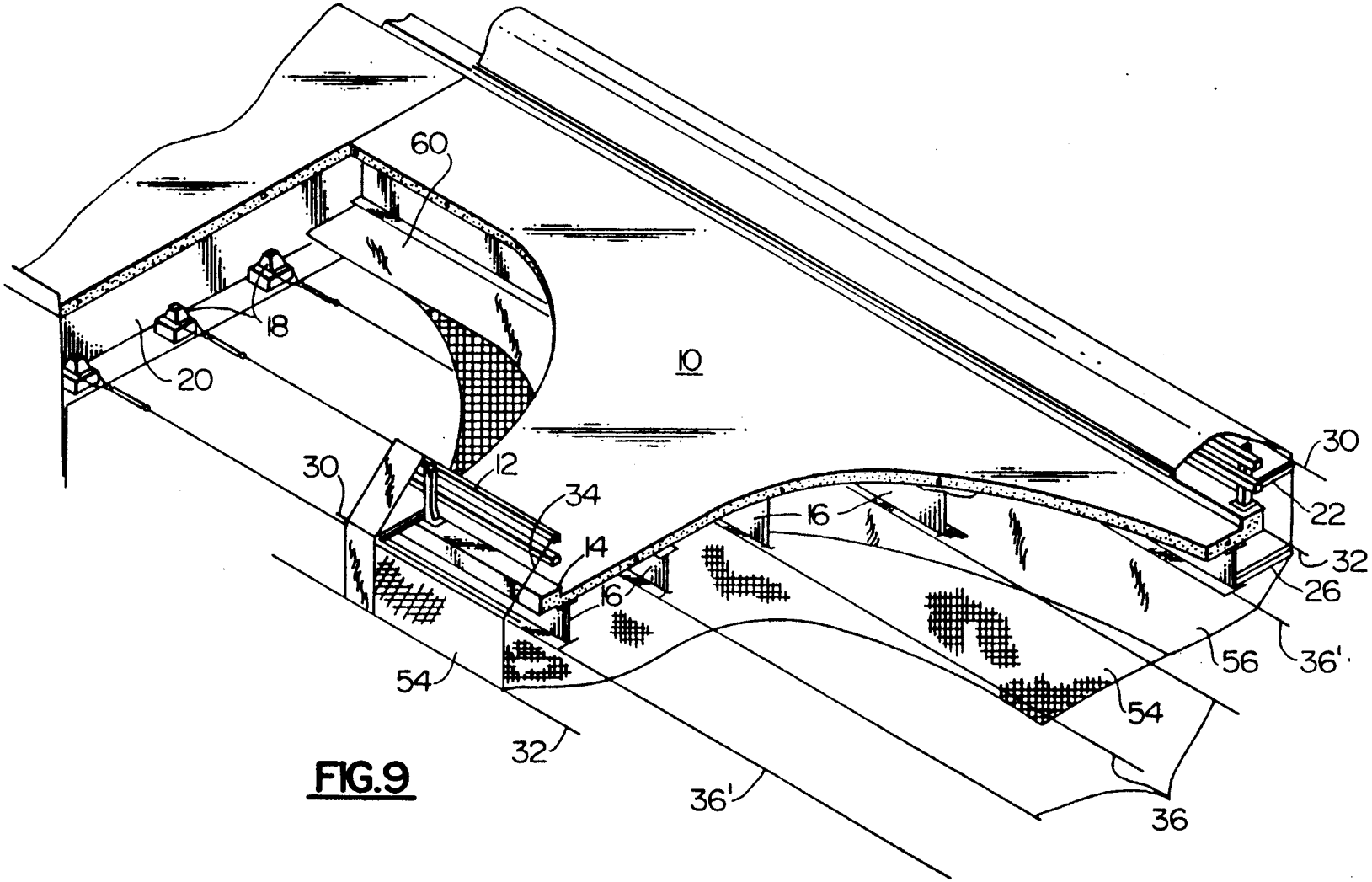
FIG. 9 is a fragmentary, perspective view, with portions broken away, of the bridge with the workplace support and enclosure installed thereon.

From cables 30, tarp 56 is passed over the top of railings 12 on each side of the bridge and down to curbs 14 where the side edges of the tarp are secured by lengths of 2×4 lumber 65 nailed to the curbs. In addition to being secured in essentially sealed relation to the bridge structure along each lateral side, tarp 56 is affixed at its opposite ends in essentially sealed relation (e.g., using duct tape or other conventional sealing means) to either horizontally or vertically disposed surfaces of the bridge substructure, including bearings 18 where required, at the end of a span. Such sealed end portions of tarp 56 are indicated in FIG. 5 at reference numeral 60. Tarp 56 may, of course, constitute two or more initially separate pieces, in which case adjacent edge portions are sealed together by Velcro strips, tape, etc.

Figure 8:
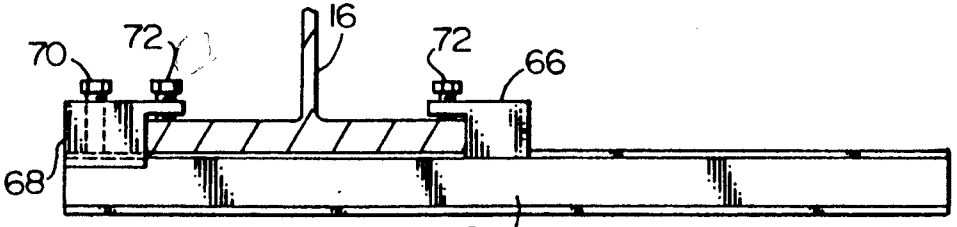
FIGS. 7 and 8 are fragmentary, side elevational views of the upper and lower, respectively, outriggers, showing the manner of attachment thereof to portions of the bridge.
Figure 7:
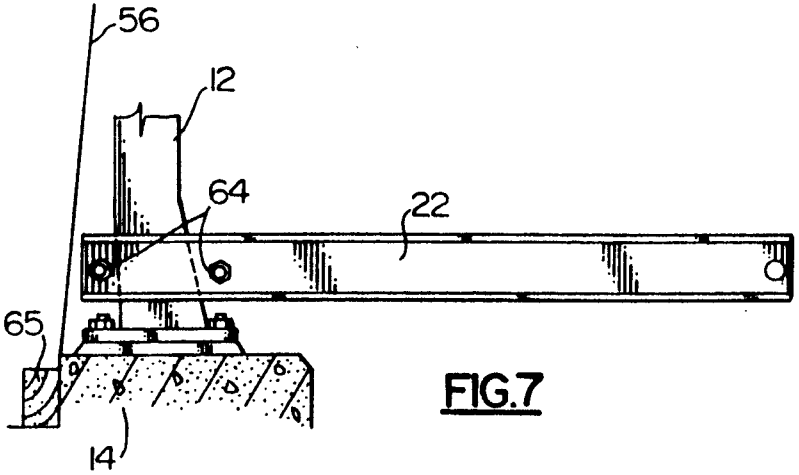
Figure 3:
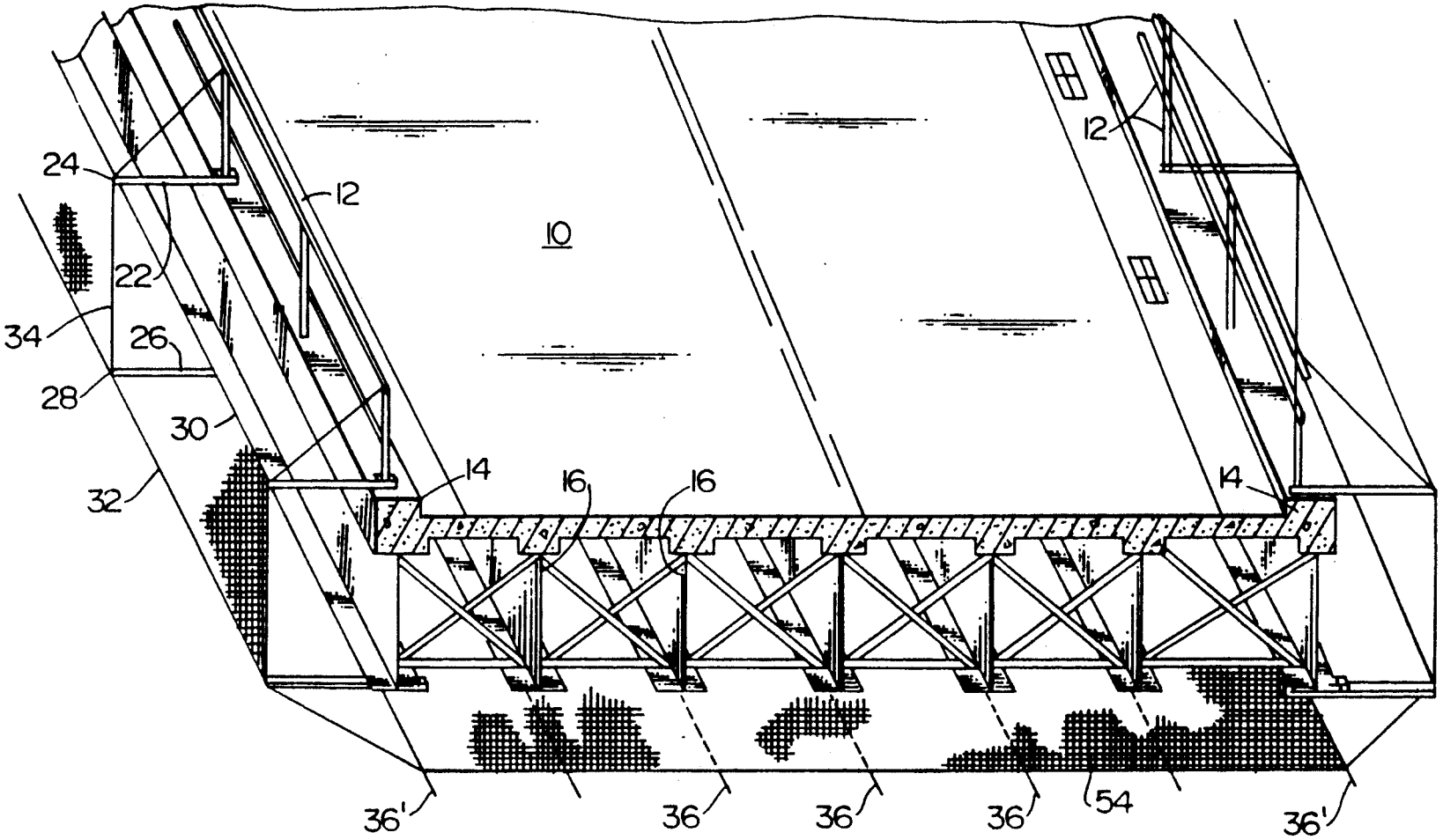
FIG. 3 is a perspective view as seen from above the end sectional view of FIG. 2.

In FIGS. 7 and 8 are shown examples of structure and manner of mounting of upper and lower outriggers 22 and 26, respectively. Each of outriggers 22 and 26 is shown as a flanged beam, e.g. w 4×13. Upper outrigger 22 is connected adjacent its inner end to upright member 62 of railing 12 by threaded rods 64, extending through central portions of outrigger 22 and through an appropriate bracket (not shown) on the opposite side of member 62 and secured by nuts on each end. A portion of tarp 56, and the lumber 65 securing it to curb 14 are also shown in FIG. 7.

Outrigger 26 is installed on the lower flange of I-beam 16 by means of fixed clip 66, which is integral with or permanently affixed to an upper, intermediate portion of outrigger 26, and adjustable clip 68, which slides on the inner end of the outrigger and over the I-beam flange. Outrigger 26 is secured by tightening set screw 70 against the top of the outrigger and set screws 72 against the top of the I-beam flange. It will be understood that outriggers 22 and 26 may take forms other than that illustrated, and may be affixed to portions of the bridge in any manner commensurate with performing their intended functions.

From the foregoing, it will be appreciated that the illustrated and described structure provides a fully enclosed workplace beneath and on each outer side of the bridge upon which it is installed. Entry into and exit from the enclosed space is provided at one or more locations by openings in fencing 54 and tarp 56 with rolling scaffold 70 locked in place thereunder. The scaffold includes a ladder and any appropriate platform(s), as is conventional, and is enclosed by a flexible fabric or plastic covering, whereby door 72 and a reliable closure for the openings in the fencing and tarp provide an air-lock entry.

Conventional blower structure, indicated by block 74, is connected by piping 76 to an opening in tarp 56. Appropriate filters may be incorporated in or associated with blower 74 to collect airborne particles. Blower 74 serves to exhaust air from the enclosed workplace, maintaining the pressure therein below the surrounding atmospheric pressure. Of course, multiple blowers may be employed if the volume of the enclosed space so dictates. Furthermore, although piping 76 is shown attached to an opening in the horizontal portion of tarp 56, whereby blower 74 creates a downdraft within the enclosed area, it is equally feasible to connect the piping through an opening in the side portion(s) of the tarp to create a cross draft, if desired. Ventilation openings (not shown) may be provided at desired locations for entry of outside air into the enclosure at a rate which does not compromise the subatmospheric pressure within the enclosed space. Additional ventilation may be provided through the small openings in the tarp through which the fasteners or clips pass to attach the tarp to the fencing and/or cables. If joints or other openings in the bridge structure admit more air than desired, they may be covered and taped or otherwise temporarily sealed. The system adds relatively little to wind loads on the bridge and may be designed to carry line loads up to 100 pounds per square foot. It should also be noted that by fully enclosing the working area in the manner indicated, locations beneath the bridge are protected from falling debris, etc., and such areas remain essentially unobstructed.

Thus, the workplace support system of the invention provides a totally enclosed volume from which it is virtually impossible to fall. In addition to the enhance physical safety, eliminating the necessity for tethers and other such safety devices, the system provides for superior environmental protection qualities. The volume surrounded by the tarp is relatively small in comparison to the available working area, allowing use of smaller scale air evacuation and dust collection equipment while complying with more stringent recent laws and regulations relating to lead containment. Typically, the system would be installed on two consecutive bridge spans at a time; since the two sections of enclosure are sealed from one another, workmen may sandblast in one section while others are painting in the adjacent section. The relatively simple nature of the various elements which make up the system permits relatively fast installation and removal and ready adaptation to various types of bridge structures.

What is claimed is:

1. A workplace support and containment system for temporary installation in a fixed position upon an existing bridge, or the like, to provide an enclosed workplace beneath the substructure extending laterally the full width of the bridge and longitudinally between underlying transverse bridge supports at two span-terminating locations, said system comprising:

a) a plurality of first cables, each fixedly connected at opposite ends to said underlying bridge supports to lie in a substantially common, first horizontal plane spaced a predetermined distance below said substructure, two outermost of said cables being spaced from one another by a distance at least substantially as great as the width of said bridge;

b) an open-link, load-bearing flooring supported by said cables and extending substantially fully between said outermost cables and said transverse bridge supports;

c) a layer of flexible material covering substantially all of said flooring and having opposite ends substantially sealed with respect to said underlying bridge supports and opposite sides substantially sealed with respect to portions of said bridge adjacent opposite longitudinal sides thereof, whereby said flexible material and portions of said bridge define an essentially fully enclosed space; and d) means for maintaining said enclosed space at a subatmospheric pressure.

2. The system of claim 1 wherein said flooring comprises chain-link fencing.

3. The system of claim 2 wherein said fencing comprises metal chain iinks with a rubber or plastic coating.

4. The system of claim 1 and further including a plurality of outrigger elements removably attached to and extending outwardly from existing structure and spaced from one another along each side of said bridge, said outrigger elements having outer terminal ends substantially linearly aligned, and a pair of second cables respectively extending along and supported by said terminal ends along each side of said bridge.

5. The system of claim 4 wherein said second cables are at a vertical height above said first cables, and said flooring extends at opposite sides from the outermost of said first cables to said second cables, and further including means connecting opposite side edges of said fencing to said second cables.

6. The system of claim 1 and further including first and second pluralities of upper outrigger elements, and first and second pluralities of lower outrigger elements, means removably attaching each of said upper and lower outriggers to existing bridge structure with said first pluralities of each of said upper and lower outrigger elements extending outwardly to respective terminal ends from one lateral side of said bridge, and said second pluralities of each of said upper and lower outrigger elements extending outwardly to respective terminal ends from the other lateral side of said bridge, said first and second pluralities of upper outrigger elements lying in a substantially common, second horizontal plane, and said first and second pluralities of lower outrigger elements lying in a substantially common, third horizontal plane below said second plane.

7. The system of claim 6 wherein said third plane is above said first plane.

8. The system of claim 6 and further including a pair of second cables respectively extending along and supported by said terminal ends of said first and second pluralities of upper outriggers, and a pair of third cables respectively extending along and supported by said terminal ends of said first and second pluralities of lower outriggers.

9. The system of claim 6 wherein at least some of said upper and lower outrigger of each of said first and second pluralities are installed in direct vertical alignment, and further including a plurality of outrigger support cables connected to portions of said bridge structure at respective locations above said second plane and to said terminal ends of ones of each of said upper and lower outriggers which are in said direct vertical alignment.

10. The system of claim 1 wherein said flexible material is a tarpaulin.

11. The system of claim 10 wherein said subatmospheric pressure maintaining means comprises exhaust blower means communicating with said enclosed space through an opening in said tarpaulin.

12. The system of claim 11 wherein said tarpaulin is substantially sealed to curbs adjacent opposite longitudinal sides of the upper surface of said bridge.

13. A workplace support and containment system providing an enclosed work area below and outwardly of both sides of the substructure of an existing bridge, or the like, said system comprising:

a) a plurality of first cables removably affixed at opposite ends to portions of said bridge to lie in a substantially horizontal, first plane an appropriate distance below said substructure to permit workmen supported at said first plane to perform tasks such as sandblasting, painting, etc. upon said substructure, said plurality of first cables including a pair of outermost cables extending substantially parallel to the longitudinal centerline of said bridge and spaced from one another by substantially the full lateral width of said bridge and a plurality of intermediate cables between said outermost cables;

b) a first plurality of outrigger members removably affixed to portions of said bridge to extend outwardly, in horizontally spaced relation to one another, from one lateral side of said bridge;

c) a second plurality of outrigger members removably affixed to portions of said bridge to extend outwardly, in horizontally spaced relation to one another, from the other lateral side of said bridge;

d) a load-bearing flooring supported by at least some of said first cables;

e) an enclosure-forming material extending over said first plane having said outermost cables and between opposite longitudinal ends, each substantially sealed with respect to said bridge substructure, and including side portions supported by said first and second outrigger members and lateral edges substantially sealed with respect to said bridge, whereby said enclosure-forming material and portions of said bridge form an essentially fully enclosed space; and f) means providing entry and exit of workmen to and from said space.

14. The system of claim 13 and further including means for maintaining said space at subatmospheric pressure.

15. The system of claim 14 wherein said flooring extends substantially the full length of said first cables and comprises chain-link fencing.

16. The system of claim 15 wherein said enclosure-forming material comprises a tarpaulin.

17. The system of claim 16 and further including a pair of second cables respectively supported by said first and second pluralities of outrigger members outwardly of lateral sides of said bridge.

18. The system of claim 17 wherein said fencing rests upon and is supported by said intermediate cables, passes under said outermost cables, and is affixed along opposite lateral sides of said fencing to said pair of second cables.

19. The system of claim 18 wherein said tarpaulin lies in superposed relation to said fencing over the full longitudinal and lateral extent of said fencing.

20. The system of claim 19 wherein said tarpaulin extends from said lateral sides of said fencing to positions along each lateral side of said bridge on the side thereof opposite said substructure.

* * * * *